US006151812A

United States Patent [19]

Bierwith

[11] Patent Number: 6,151,812

[45] Date of Patent: Nov. 28, 2000

[54] BUCKET ASSEMBLY WITH AN IMPROVED LIP

[76] Inventor: Robert S. Bierwith, 1331 Eastshore Hwy., Berkeley, Calif. 94710

[21] Appl. No.: 09/183,478

[22] Filed: Oct. 29, 1998

Related U.S. Application Data

[60] Provisional application No. 60/064,427, Oct. 30, 1997.

[51] Int. Cl.[7] ..... E02F 9/28

[52] U.S. Cl. ..... 37/455; 37/446

[58] Field of Search ..... 37/452, 455, 456, 37/457, 458, 450, 453, 446; 403/379, 374; 172/753

[56] References Cited

U.S. PATENT DOCUMENTS

| | | | |
|---|---|---|---|
| 4,067,657 | 1/1978 | Kaarlela . | |
| 4,481,728 | 11/1984 | Mulder et al. . | |
| 4,516,340 | 5/1985 | Launder | 37/457 |
| 4,918,843 | 4/1990 | Kiiesewetter et al. | 37/457 |
| 5,052,134 | 10/1991 | Bierwith | 37/450 X |
| 5,068,986 | 12/1991 | Jones | 37/457 |
| 5,205,057 | 4/1993 | Garman | 37/452 X |
| 5,412,885 | 5/1995 | Cornelius | 37/453 X |
| 5,709,043 | 1/1998 | Jones et al. . | |
| 5,765,301 | 6/1998 | Clendenning | 37/455 X |
| 5,926,982 | 7/1999 | Keech et al. | 37/455 |
| 5,983,534 | 11/1999 | Robinson et al. | 37/452 |

*Primary Examiner*—Robert E. Pezzuto

*Attorney, Agent, or Firm*—Townsend and Townsend and Crew LLP

[57] ABSTRACT

An excavation bucket assembly for an excavation apparatus such as a front-end loader includes a plurality of shrouds and tooth assemblies mounted along a lip of the bucket body. The shrouds are connected via reusable connection pins that are biased within aligned connection-holes with a plunger assembly mounted within the connection pin. The connection-holes are defined by two overlapping ovals, with the proximal oval having a larger radius as compared to the distal oval. Additionally, an improved attachment pin is utilized to connect a tooth portion to a tooth body portion of the tooth assemblies that provides for a secure and reliable attachment and easy exchange of worn tooth portions.

34 Claims, 11 Drawing Sheets

BUCKET ASSEMBLY WITH AN IMPROVED LIP

This application is a continuation of and claims the benefit of U.S. Provisional Application No. 60/064,427, filed Oct. 30, 1997, the disclosure of which is incorporated herein by reference.

BACKGROUND OF THE INVENTION

1. Field of the Invention

This invention relates to buckets for excavation vehicles such as front-end loaders and, more particularly, to teeth and shrouds utilized with such buckets and the manner in which they are connected along a front lip of such a bucket.

2. Description of the Prior Art

Excavating buckets are used extensively in the construction and mining industries. The buckets are used with a variety of different excavating apparatus, such as backhoes, power shovels, front-end loaders, dragline equipment, etc. Although these buckets have many differences, they are generally formed with a rear wall, side walls, and a bottom wall. The walls cooperatively define an open front and a cavity for gathering earthen material and moving it to a dump site. The bottom edge of the open front is defined by a forward lip of the bottom wall. The lip is intended to engage the ground for collection of the material into the bucket cavity. The lip may be formed to have a linear or arcuate-shaped edge, or formed to have a particular configuration (such as V-shaped) to suit the desired operation. Similarly, the front edges of the side walls are also adapted to engage the ground.

Attachments are commonly mounted on the lip and the front edges of the side walls to increase the effectiveness and durability of the buckets. These attachments typically include teeth, shrouds and wings. The teeth project forwardly of the lip to disrupt the material for enhanced collection of the material into the cavity. The shrouds are positioned in between the teeth and are generally provided with an inclined surface to improve the collection of the material into the bucket. The wings are attached to the front edges of the side walls in general proximity with the lips. In any event, the attachments protect the bucket against undue wear. As a result, only the attachments normally need replacement when the front of the bucket becomes worn, thus prolonging the useable life of the larger and more expensive lip and side walls.

In general, a tooth comprises an adapter and a point. The adapter is attached to the lip and serves as a mount for the point. The point is a wear element and forms the forward portion of the tooth that engages the ground. The point may be attached to the adapter in a number of different ways. As a result of this two-part construction, replacement of only the point is generally needed when the tooth becomes worn.

Likewise, the shroud is a part that is subject to wear and therefore occasionally needs replacement. Typically, the shroud is mounted on the lip via a slot, which is normally an area of high stress concentration. Therefore, the slot can lead to cracking within the lip.

Accordingly, an excavation bucket assembly with an improved lip mounting for attachments such as shrouds, and having an improved connection for a point and an adapter to form a tooth, is needed.

SUMMARY OF THE INVENTION

An excavation bucket in accordance with the present invention addresses the shortcomings of the prior art.

In accordance with a preferred embodiment of the present invention, an excavation bucket assembly for an excavation apparatus such as a front-end loader comprises a bucket body having a lip running longitudinally along a bottom front portion of the bucket body and a plurality of key-holes defined within the lip. Each key-hole comprises two ovals. The excavation bucket assembly further comprises a plurality of shrouds for connection to the bucket body wherein each shroud has a connection-hole that aligns with a corresponding key-hole when its respective shroud is connected to the body. The excavation bucket assembly also comprises a plurality of tie-bars with each tie-bar being placed in a corresponding one of the key-holes and connection-holes when a shroud is connected to the bucket body. Also, the excavation bucket assembly comprises a plurality of connection pins, each connection pin being placed in a corresponding one of the key-holes and a corresponding connection-hole when a shroud is connected to the bucket body and being biased against a corresponding tie-bar.

In accordance with one aspect of the present invention, each connection-hole of the shroud has a shear groove extending radially into the shroud, and each connection pin has a biasing pin extending therefrom. Each biasing pin is spring-loaded within its corresponding connection pin and extends into a corresponding shear groove when its corresponding connection pin is placed into a key-hole and connection-hole, thereby biasing its corresponding connection pin against the corresponding tie-bar.

In accordance with a further aspect of the present invention, each connection pin further includes an oil-ring groove with an O-ring mounted therein to inhibit foreign matter from entering the shear groove.

In accordance with yet another aspect of the present invention, the two ovals of each key-hole are an overlapping circular portion and elliptical portion, the elliptical portion being located proximally with respect to the bucket body, and the circular portion being located distally with respect to the bucket body.

In accordance with yet another aspect of the present invention, a distal portion of each circular portion is open.

In accordance with still another aspect of the present invention, each connection pin is cylindrical in shape and each connection-hole includes a circular portion. Each connection pin is inserted into a circular portion of a corresponding key-hole and a circular portion of a corresponding connection-hole when a shroud is connected to the bucket body.

In accordance with yet another aspect of the present invention, each tie-bar has a first face that has a rounded contour that abuts a corresponding connection pin and a second face that abuts the lip of the bucket body and includes a concave portion.

In accordance with another preferred embodiment of the present invention, the excavation bucket assembly further comprises a plurality of tooth assemblies. Each tooth assembly comprises a body portion that fits over the lip of the bucket body, a nose portion integral with the body portion and having a hole defined therein that includes a radially extending groove, a tooth portion having a hole defined therein, and a connecting pin that comprises a top detent and a locking portion. The tooth portion is mounted over the nose portion such that their respective holes are aligned, and the connecting pin is inserted into the holes such that the top detent abuts the nose portion and the locking portion engages the radially extending groove.

In accordance with another aspect of the present invention, the top detent is part of an inner body portion of the connecting pin, and the inner body portion complises an elastomeric material.

In accordance with yet another aspect of the present invention, the inner body portion includes a biasing portion that engages the locking portion.

In accordance with a further aspect of the present invention, the tooth portion includes a recess defined therein on its underside.

In accordance with an alternative embodiment of the present invention, an excavation bucket assembly for an excavation apparatus such as a front loader comprises a bucket body having a lip running longitudinally along a bottom front portion of the bucket body, and a plurality of tooth assemblies for connection to the bucket body. Each tooth assembly comprises a body portion that fits over the lip of the bucket body, a nose portion integral with the body portion and having a hole defined therein that includes a radially extending groove, a tooth portion having a hole defined therein, and a connecting pin that comprises a top detent and a locking portion. The tooth portion is mounted over the nose portion such that their respective holes are aligned, and the connecting pin is inserted into the holes such that the top detent abuts the nose portion and the locking portion engages the radially extending groove.

Accordingly, an excavation bucket assembly in accordance with the present invention allows for shrouds to be connected to the lip of the bucket via slots that produce much lower stress concentration within the lip. Additionally, tooth assemblies for connection to the bucket assembly are constructed utilizing improved connecting pins that allow for a more reliable connection between the tooth and the nose portion, as well as allowing for easy replacement of the tooth portion.

DESCRIPTION OF THE SPECIFIC EMBODIMENTS

Figure 1:
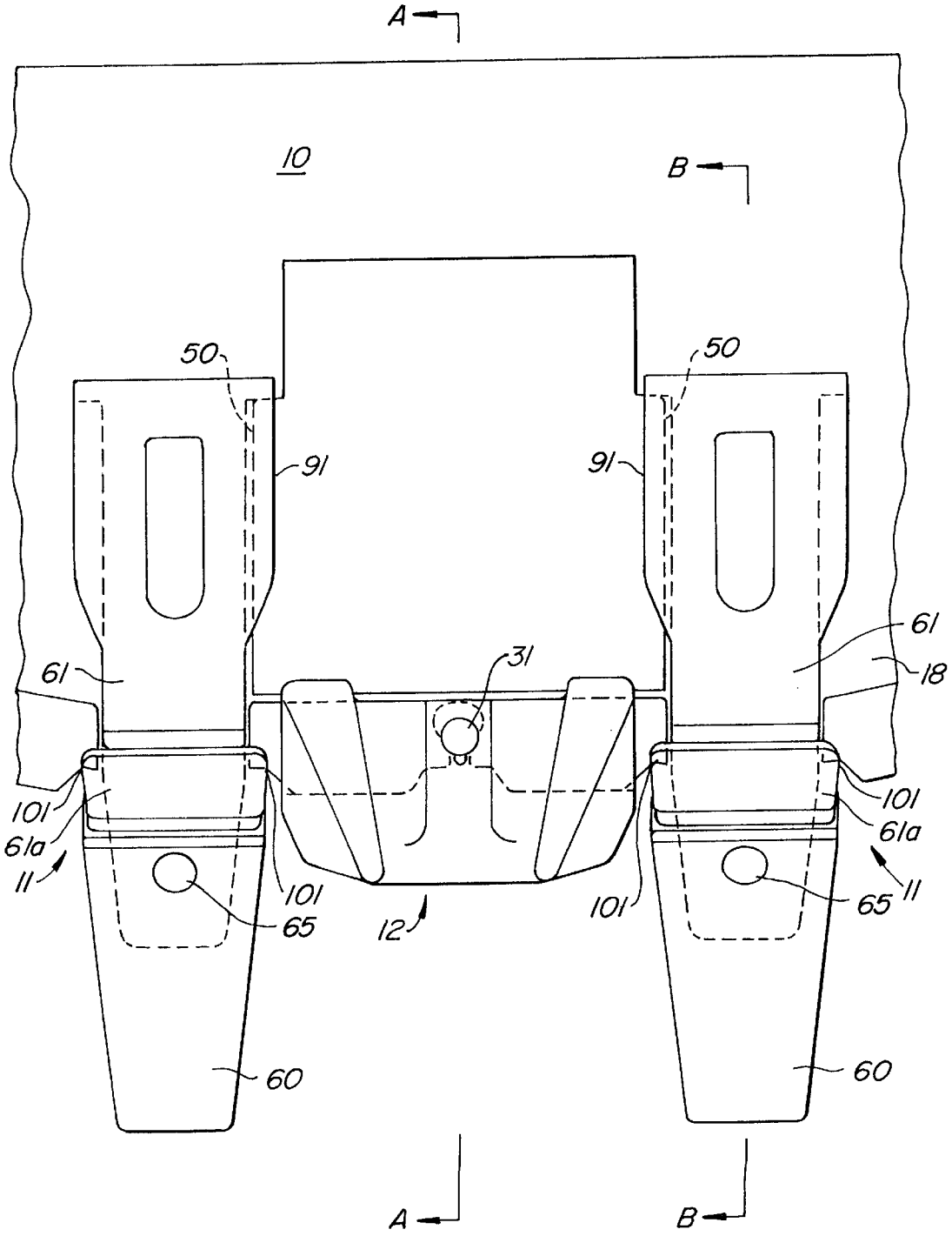
FIG. 1 is a plan view of a portion of an excavation bucket assembly in accordance with the present invention illustrating a shroud and two tooth assemblies connected to a lip of the bucket assembly.

Referring to the figures, and more particularly to FIG. 1, a portion of an excavation bucket assembly comprises a bucket body 10, a plurality of tooth assemblies 11 connected to the bucket body, and a plurality of shrouds 12 interspersed between the tooth assemblies and also connected to the bucket body. Along a front portion of bucket body 10 is a lip 18 that runs longitudinally along the bottom wall of the bucket body and over which the tooth assemblies and shrouds are connected.

Figure 2:
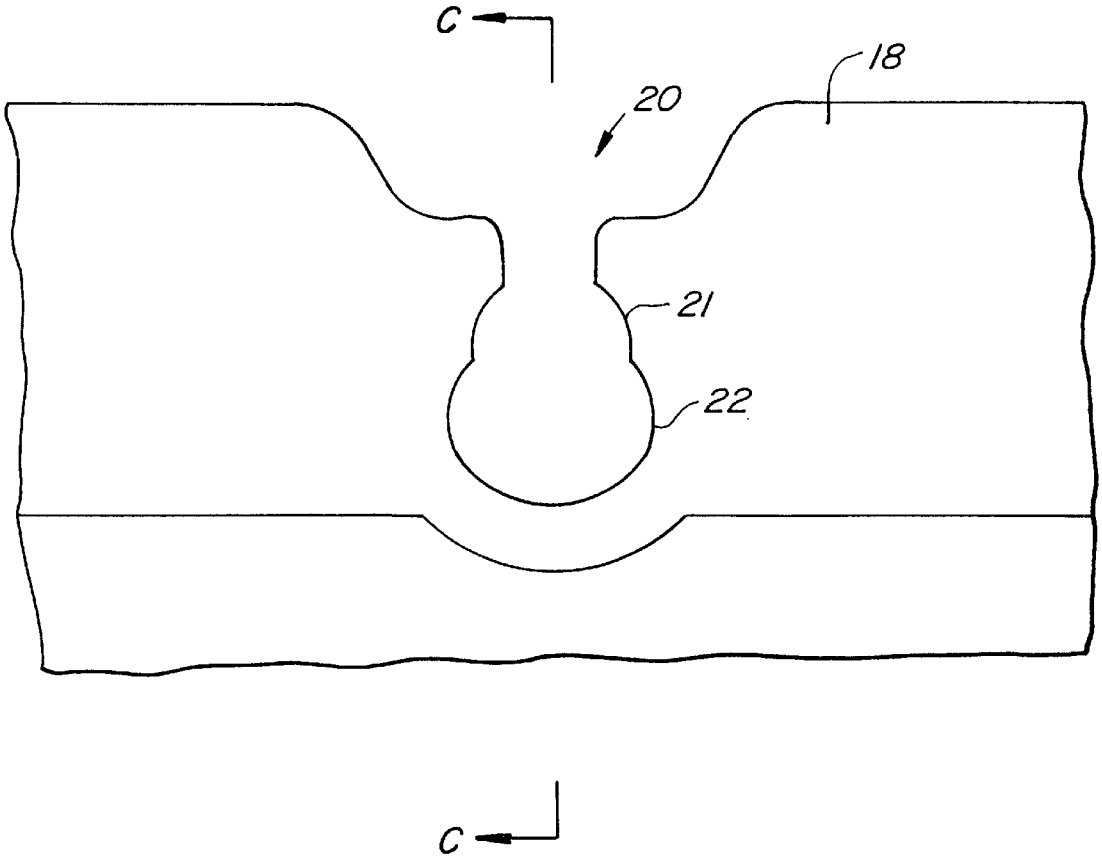
FIG. 2 is an enlarged plan view of a key-hole within the lip or connection of a shroud thereto.
Figure 2A:
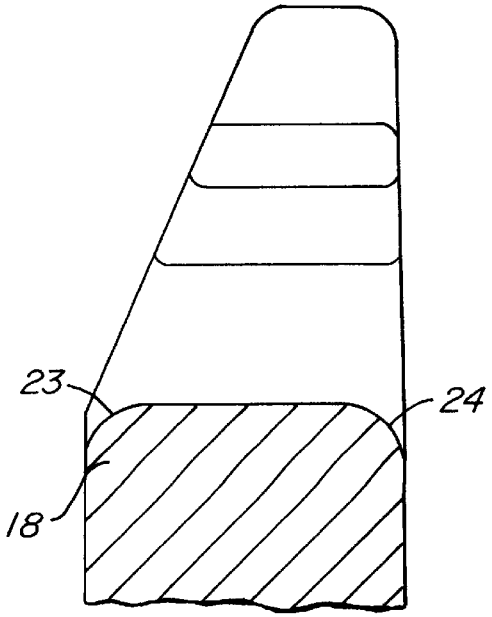
FIG. 2A is a sectional view of the key-hole as seen along the line C—C in FIG. 2.

As best seen in FIG. 2, lip 18 has a plurality of key-holes 20 defined therein. Each key-hole 20 is defined by overlapping apertures 21, 22. In the preferred embodiment, aperture 21 is a substantially circular portion, while aperture 22 is a substantially elliptical portion. The elliptical portion is located proximally with respect to the bucket body, while the circular portion is located distally with respect to the bucket body. As can be seen in FIG. 2A, each key-hole 20 is defined along the lip with a sloping portion 23 at the top of lip 18 and a sloping portion 24 at the bottom of lip 18.

Figure 1A:
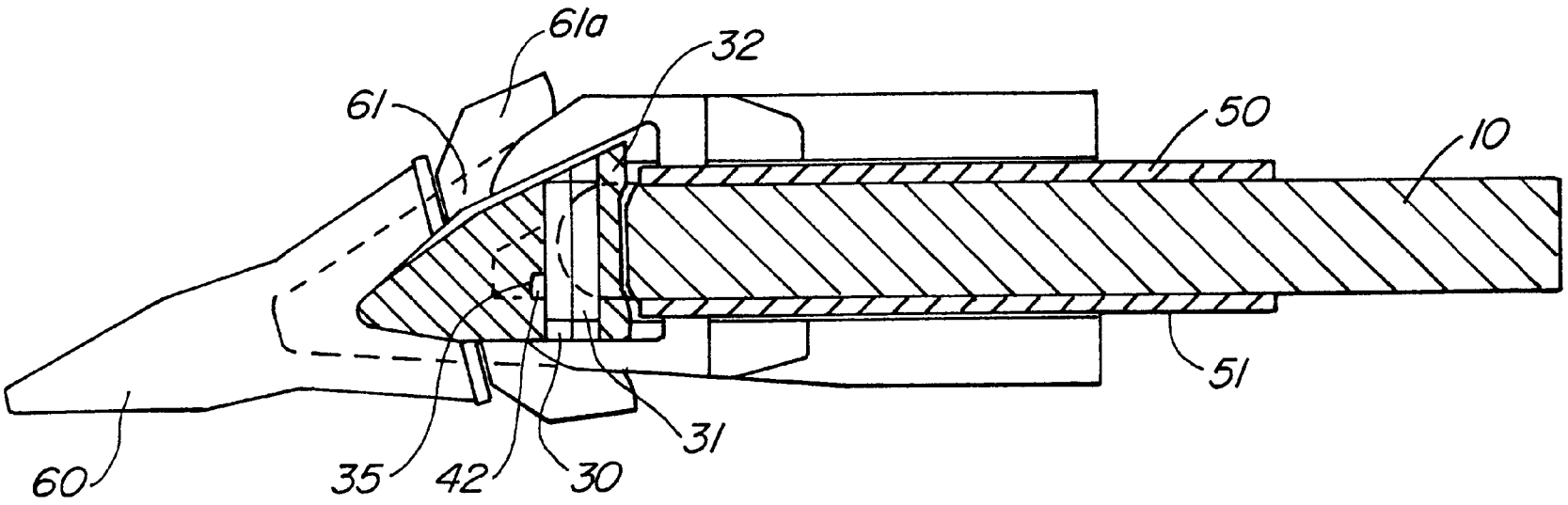
FIG. 1A is a sectional view of a shroud connected to the lip as seen along the line A—A in FIG. 1.

As can be seen in FIGS. 1 and 1A, a shroud 12 is mounted to bucket body 10 over lip 18 so that aperture 30 within the shroud 12 is aligned with key-hole 20. The shroud is affixed to the bucket body with connection pin 31 and tie-bar 32. Tie-bar 32 conforms to the lip of the bucket body, including corresponding to sloping portions 23 and 24. Preferably, shroud 12 is a casting that includes a tie-bar 32.

Figure 3A:
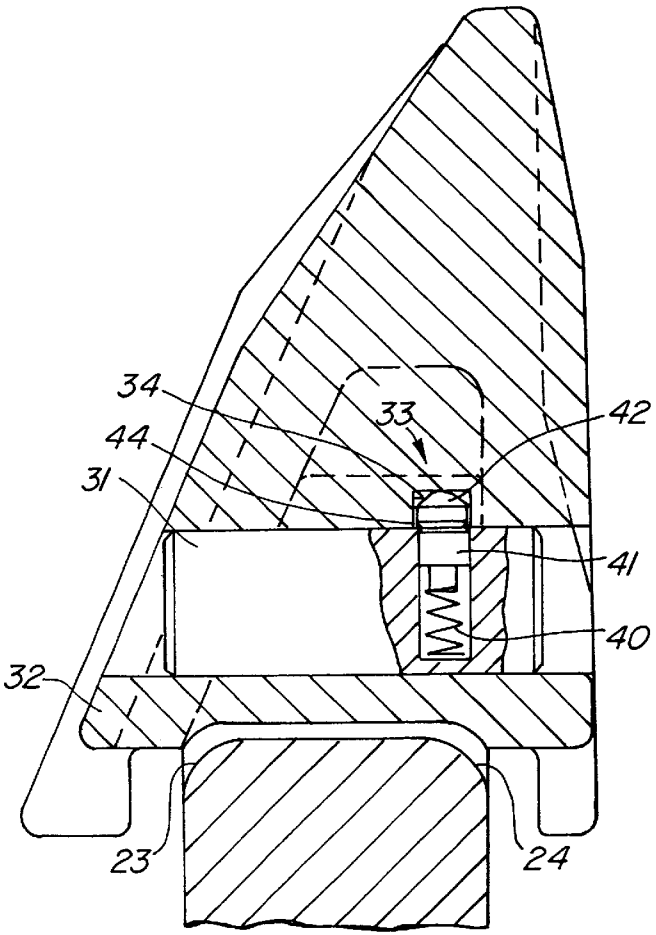
FIG. 3A is a sectional view of the shroud connected to the lip via the key-hole as seen along the line D—D of FIG. 3.
Figure 3:
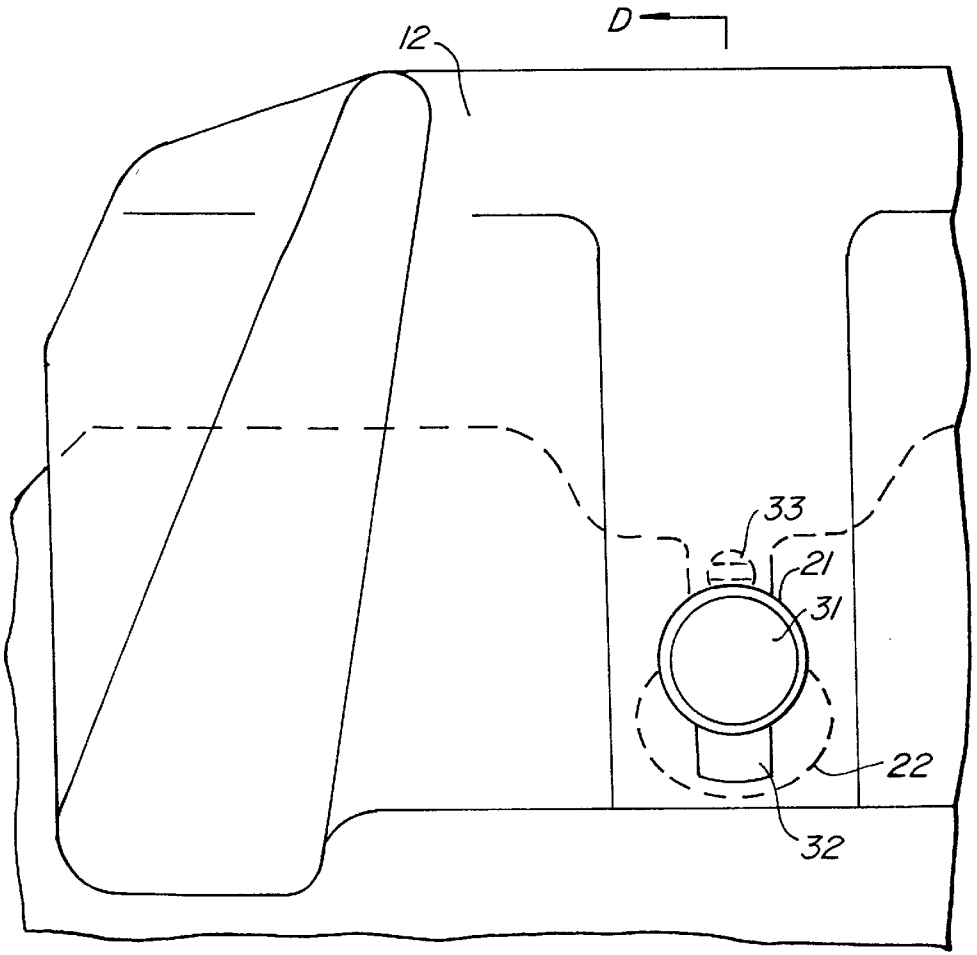
FIG. 3 is an enlarged plan view of a shroud connected to the lip via the key-hole.
Figure 4A:
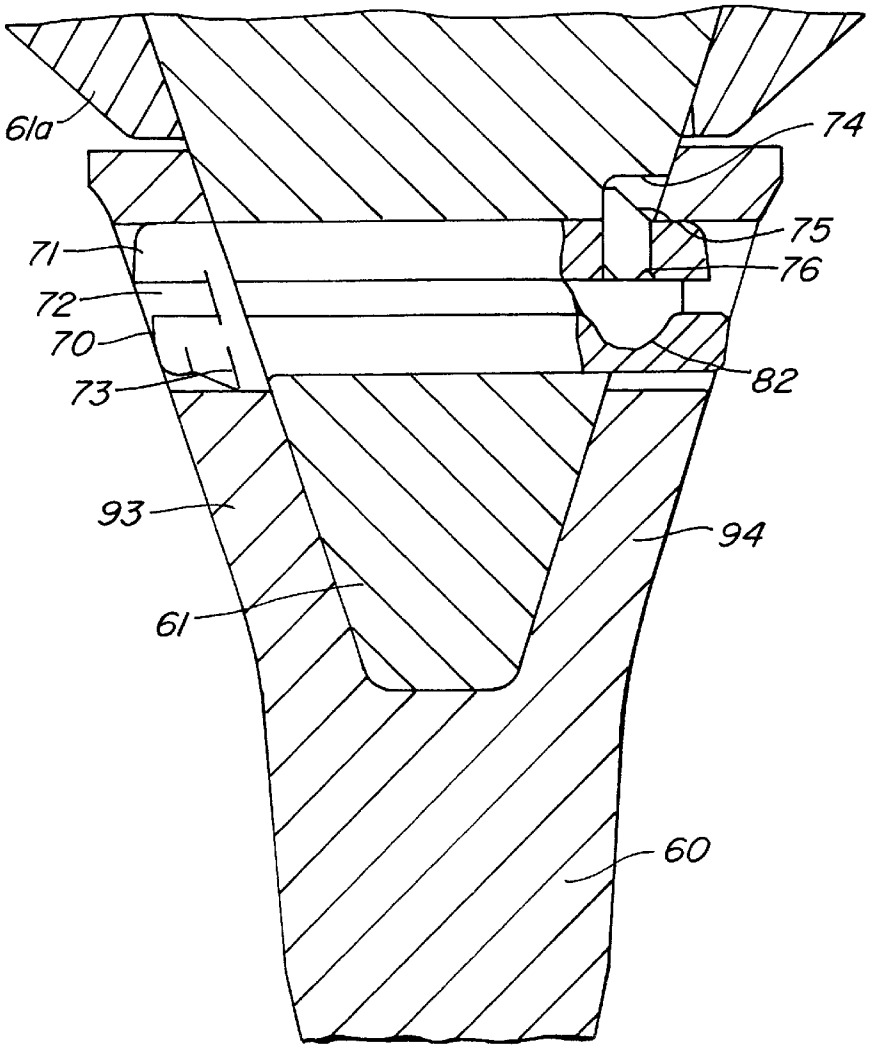
FIG. 4A is a sectional view of a nose portion of a tooth assembly connected to a body portion of a tooth assembly as seen along the line A—A in FIG. 4.
Figure 4:
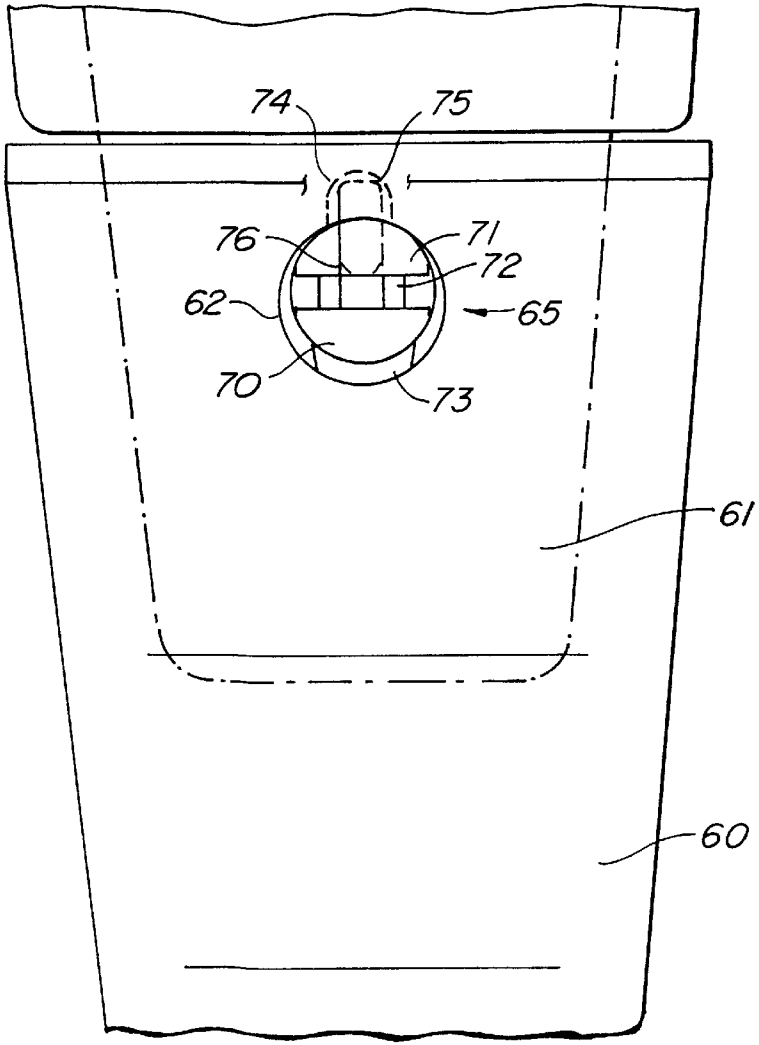
FIG. 4 is an enlarged plan view illustrating a nose portion of a tooth assembly connected to a body portion of a tooth assembly.

As best seen in FIGS. 3 and 3A, pin 31 includes a biasing member 33 mounted within bore 35 that biases connection pin 31 against tie-bar 32. Biasing member 33 engages a shear groove 34 defined within and extending radially from connection-hole 30.

Figure 6A:
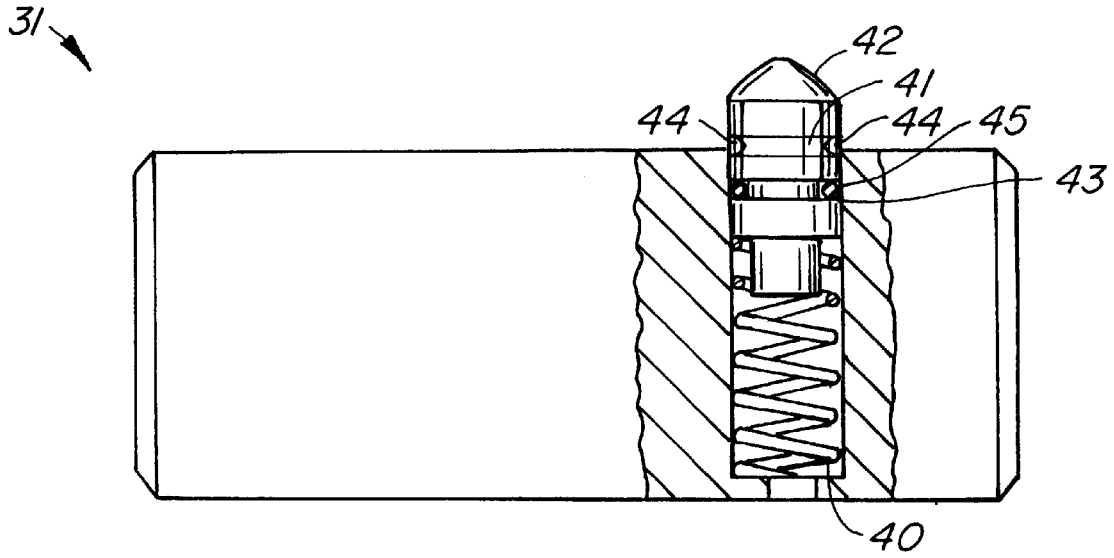
FIG. 6 is a side elevation view of a connection pin for connecting shrouds to the lip in accordance with the present invention.
Figure 6B:
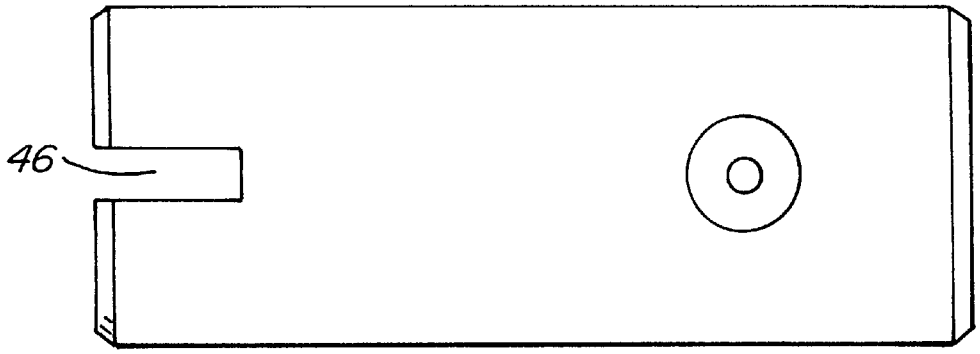

FIG. 6 illustrates connection pin 31 and biasing member 33. In the preferred embodiment, biasing member 33 is a plunger assembly that includes a spring 40 and a plunger 41. Plunger body 41 includes a rounded head portion 42, a ring slot 43, and a plunger shear groove 44. Ring slot 43 receives an O-ring 45 for protecting bore 35 from dirt, dust, oil and the like. Connection pin 31 also includes an adjustment slot 46 defined within a top portion of the connection pin. Preferably, connection pin 31 is made of 8620 steel and the outside surface is carbonized. Connection pin 31 is therefore ductile and abrasion resistant.

Accordingly, in order to attach a shroud 12 to bucket body 10 along lip 18, the shroud is slid over lip 18 so that upper shroud body portion 50 is over the top of bucket body 10, while lower shroud body portion 51 is under bucket body 10, and so that aperture 30 is aligned with a key-hole 20. A connection pin 31 is then hammered or driven through the aligned aperture 30 and key-hole 20. An adjustment slot 46 on connection pin 31 is then utilized to "screw" or adjust the positioning of connection pin 31 within the aligned aperture 30 and key-hole 20 such that biasing member 33 engages bore 35. Spring 40 biases the biasing member 33 into bore 35 to thereby ensure that connection pin 31 and tie-bar 32 are securely held within the aligned aperture 30 and key-hole 20, and thus securely attach shroud 12 to bucket body 10.

One of the advantages of the present invention is that connection pin 31 is reusable. When a shroud 12 needs to be replaced, connection pin 31 is driven with a hammer or mallet out of the aligned aperture 30 and key-hole 20. Plunger body 41 shears at plunger shear groove 44 to thereby allow connection pin 31 and tie-bar 32 to be removed from aperture 30 and key-hole 20. A new shroud is then mounted to bucket body 10 and a new biasing member is mounted to connection pin 31, and the new shroud is then attached as described above.

Sloping portions 23, 24 help prevent cracking within the metal since cracking normally begins towards increasing metal thickness. Additionally, the larger radius of aperture 22 reduces stress concentrations. Typically, key-hole 20, in prior art configurations (generally circular in shape), is a high stress area, where shroud 12 is typically connected. The larger radius of aperture 22 reduces the stress and therefore helps prevent cracking within lip 18. Additionally, tie-bar 32 prevents spreading so that shroud 12 can wear very thin without spreading. Tie-bar 32 also provides guidance for connection pin 31 during assembly. Without tie-bar 32, spring-loaded plunger body 41 will tend to deflect connection pin 31 and misalign it with respect to bore 35, thereby making it difficult or even impossible to insert.

Figure 1B:
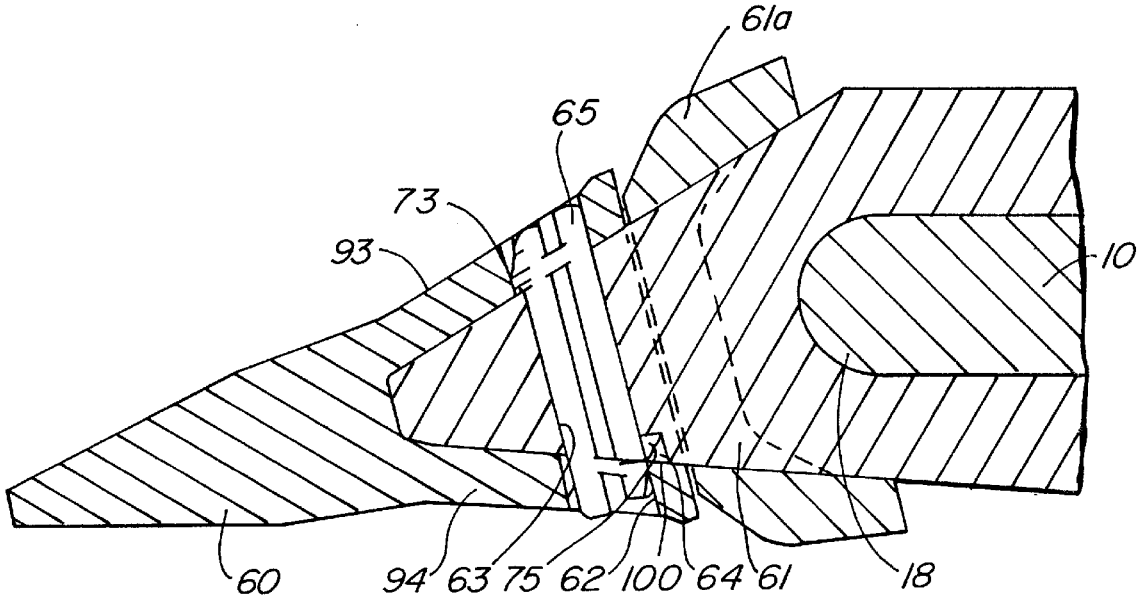
FIG. 1B is a sectional view of a tooth assembly connected to the lip as seen along the line B—B in FIG. 1.

Turning to FIG. 1B, a tooth assembly 11 comprises a tooth 60, a body portion 61, and a tooth shroud 61*a*. Tooth 60 has defined therein a tooth connection-hole 62, while tooth body portion 61 includes a tooth mounting hole 63. Extending radially from tooth mounting hole 63 is a locking slot 64. In order to attach tooth 60 to tooth body portion 61, an attachment pin 65 is utilized.

Figure 5C:
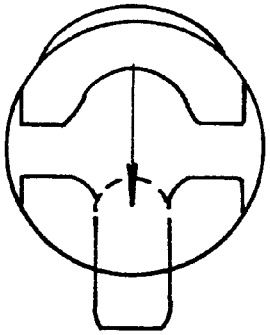
FIG. 5 is a side elevation view of an attachment pin for connecting a tooth portion of a tooth assembly to a body portion in accordance with the present invention.
Figure 5A:
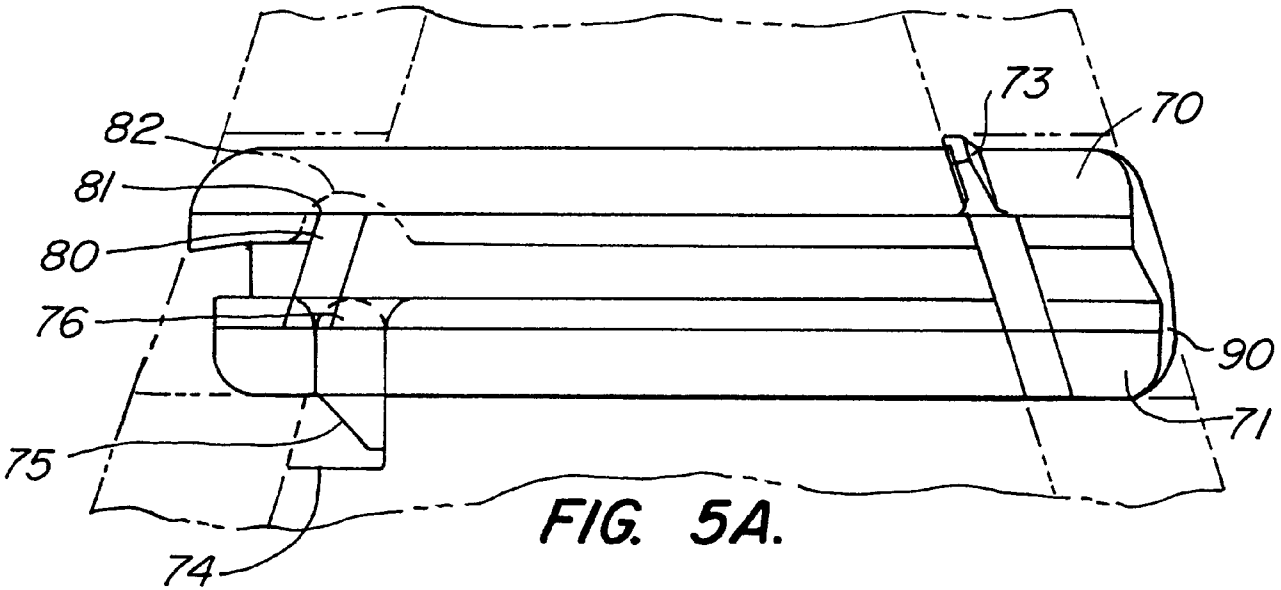
Figure 5B:
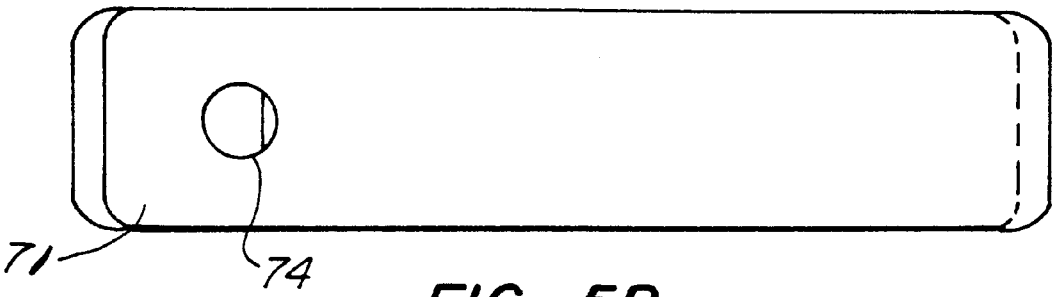

As can be seen in FIG. 5, attachment pin 65 includes a first side portion 70 and a second side portion 71 and an interior body portion 72. First side portion 70 includes a lip or protrusion 73 that extends outwardly. Second side portion 71 has a bore 74 defined therein. A locking plunger 75 is placed within bore 74 and has an end portion 76 that engages interior body portion 72. Opposite of locking plunger 75 is an engagement member 80 that includes an end portion 81. End portion 81 engages a biasing portion 82 of interior body portion 72. Biasing portion 82 is placed within biasing groove 83 of first side portion 70.

In the preferred embodiment, the interior body portion is comprised of an elastomeric material such as rubber. Preferably, the interior body portion extends over top portion 90 of attachment pin 65 and encases engagement member 80.

A tooth portion 60 is connected to tooth body portion 61 such that an upper portion 93 of tooth portion 60 is placed over tooth body portion 61, while a lower portion 94 is placed under tooth body portion 61, such that tooth connection-hole 62 is aligned with tooth mounting hole 63. Tooth body portion 60 abuts tooth shroud 61*a*. An attachment pin 65 is then driven through the aligned holes 62, 63 until lip 73 engages tooth body portion 61. Biasing portion 82 biases engagement member 80 against locking plunger 75 and into bore 74, thereby locking attachment pin 65 in place to securely attach tooth portion to tooth body portion 61.

When a tooth assembly 11 is connected to bucket body 10, tooth body portion 61 is placed such that upper tooth body portion 91 is over the bucket body 10, while lower body portion 92 is under the bucket body 10. Tooth assembly 11 is then attached to bucket body 10 in a manner known in the art.

Accordingly, tooth portion 60 can be attached to tooth body portion 61 prior to mounting tooth assembly 12 to bucket body 10 or after such mounting. In fact, in accordance with one of the features and advantages of this invention, tooth portion 60, as well as tooth shroud 61*a*, can be replaced without removing tooth body portion 61. In order to replace tooth portion 60, attachment pin 65 is driven from aligned holes 62, 63. This is possible since locking plunger 75 is angled such that a lip portion 100 of tooth 60 will drive locking plunger 75 against biasing portion 82 due to the sloping nature of locking plunger 75. Lip or protrusion 73 will be sheared from attachment pin 65.

As can be seen in FIG. 1, upper body portion 91 is placed over a portion of upper shroud body portion 50, while lower body portion 92 of tooth assembly 12 is placed over lower body portion 51 of shroud 12 to thereby help in securing shroud 12 to bucket body 10. Additionally, a portion of tooth shroud 61 a overlaps a portion of shroud 12 at lip portion 101 to thereby aid in maintaining connection of shroud 12 to bucket body 10.

Figure 7:
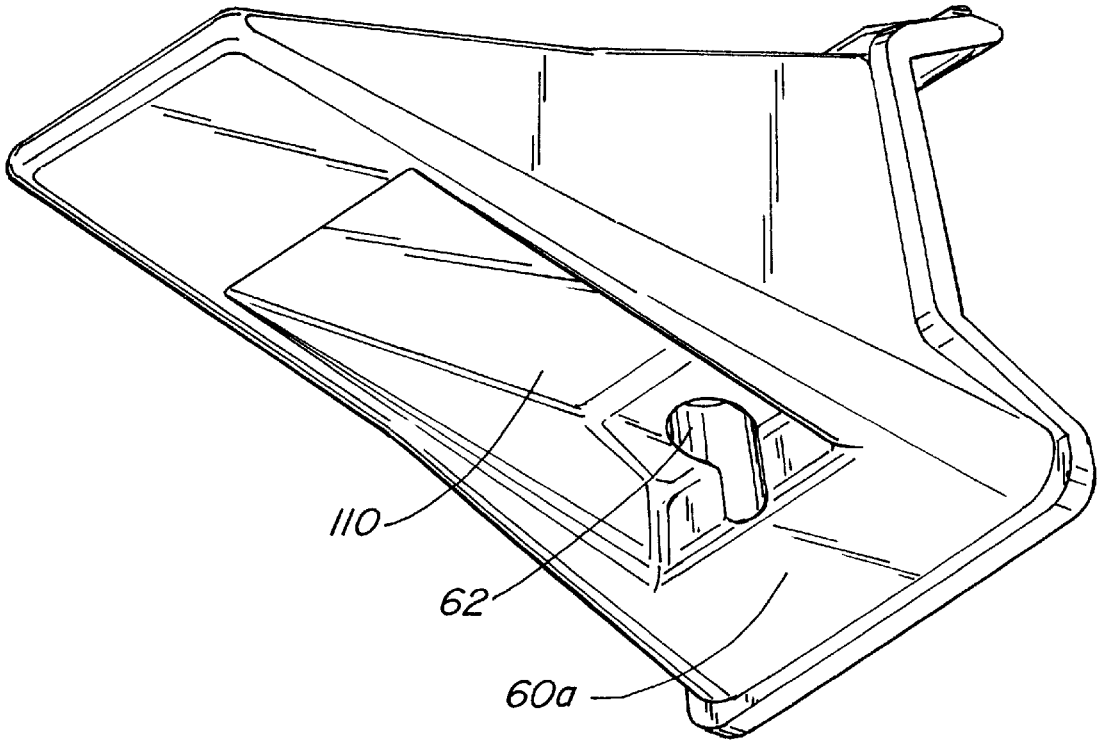
FIG. 7 is a perspective view of an alternative embodiment of a tooth portion of a tooth assembly in accordance with the present invention.
Figure 8:
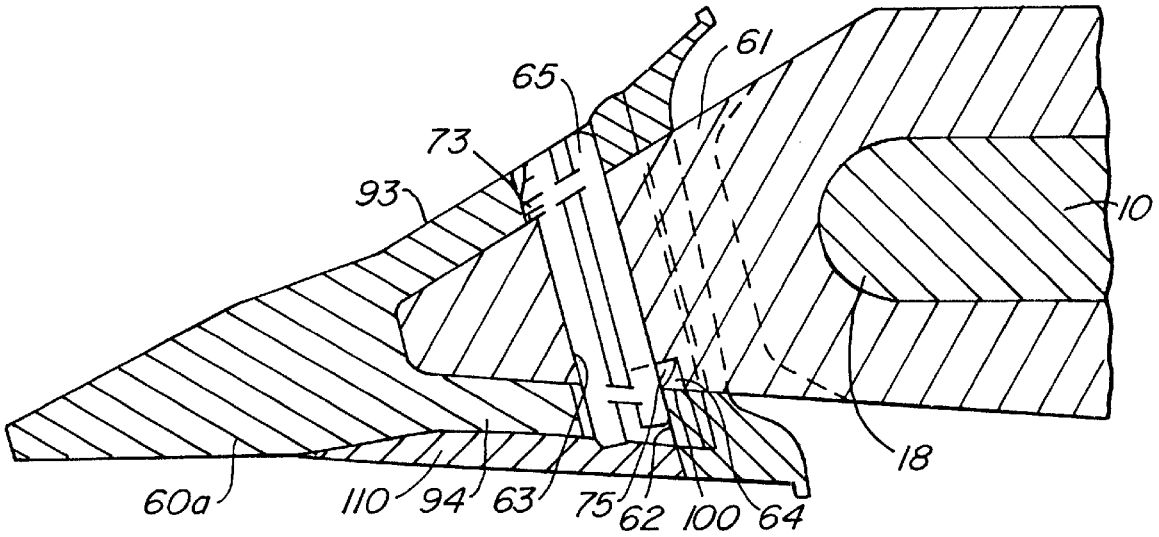
FIG. 8 is a sectional view of a tooth assembly, with the tooth of FIG. 7, connected to the lip as seen along the line BB in FIG. 1.
Figure 9:
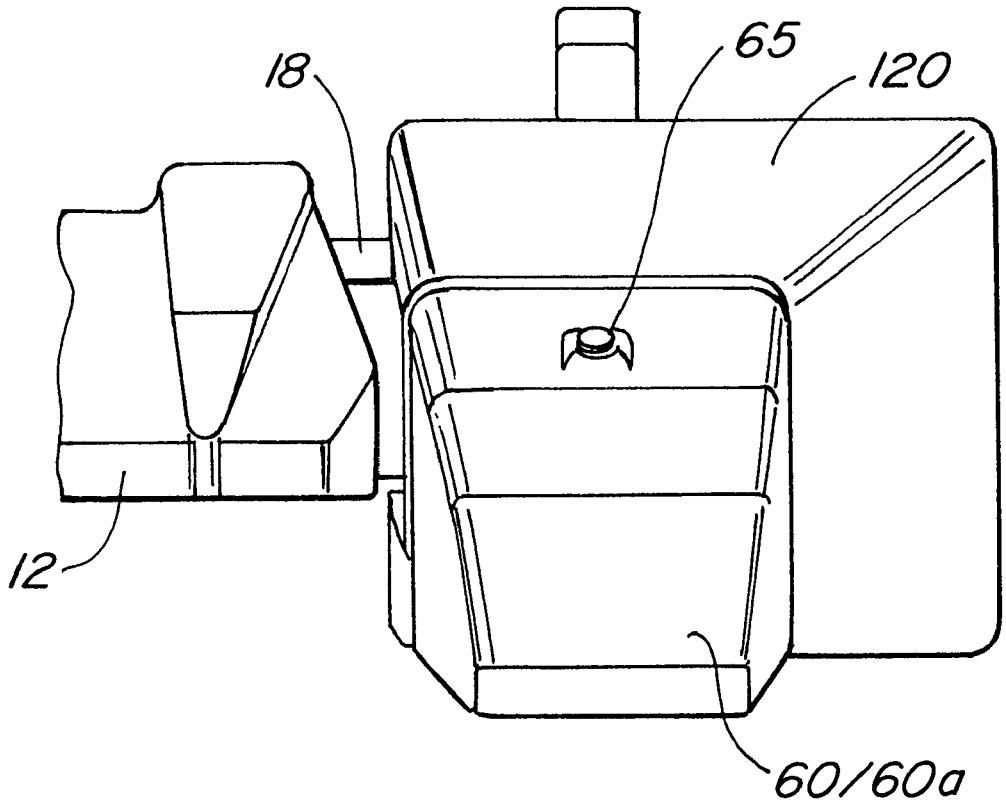
FIG. 9 is a front elevation view of a tooth assembly connected to the lip with a corner adapter shroud in accordance with the present invention.

FIG. 7 illustrates an alternative embodiment of a tooth portion 60*a* that is not used with a tooth shroud 61*a*. FIG. 8 illustrates such a tooth portion 60*a* coupled to a body portion 61.

Tooth 60*a* includes a recessed potion 110. When in use, recess portion 110 accumulates dirt and other material to form a protective barrier or seal on the underside of tooth 60*a*. Indeed, it may accumulate enough dirt to raise the tooth off the ground surface to protect the underside of tooth portion 60*a*.

Furthermore, dirt may accumulate and pack in and around tooth portion 60*a* and tooth portion 61, thus providing a tight connection and seal.

Thus, the embodiment illustrated in FIGS. 7 and 8 allows for the use of less metal overall and easier manufacture of the tooth at a reduced price.

Finally, FIG. 10 illustrates a comer shroud 120 that is placed over tooth portion 61 at the corners of the bucket body along lip 18, i.e., at the ends of lip 18. A tooth portion 60 (with tooth shroud 61*a*) or 60*a* is then abutted against comer shroud 120 and connected with an attachment pin 65 into aligned holes 62, 63, as previously described.

Accordingly, the present invention provides an excavation bucket assembly that allows for shrouds to be connected to the lip of the bucket via slots that produce much lower stress concentrations within the lip. Additionally, connection pins for connecting the shrouds to the lip of the bucket are reusable. Finally, tooth assemblies for connection to the bucket assembly are constructed utilizing improved connecting pins that allow for a more reliable connection between the tooth and the nose portion, as well as allowing for easy replacement of the tooth portion.

Although the invention has been described with reference to specific exemplary embodiments, it will be appreciated that it is intended to cover all modifications and equivalents within the scope of the appended claims.

What is claimed is:

1. An excavation bucket assembly for an excavation apparatus the assembly comprising:

a bucket body having a lip running longitudinally along a bottom front portion of the bucket body;

a plurality of key-holes defined within the lip, each key-hole comprising two ovals, a plurality of shrouds for connection to the bucket body, each shroud having a connection-hole that aligns with a corresponding key-hole when its respective shroud is connected to the body;

a plurality of tie-bars, each tie-bar being placed in a corresponding one of the key-holes and connection-holes when a shroud is connected to the bucket body; and a plurality of connection pins, each connection pin being placed in a corresponding one of the key-holes and a corresponding connection-hole when a shroud is connected to the bucket body and being biased against a corresponding tie-bar.

2. The excavation bucket assembly of claim 1 wherein each connection-hole of the shroud has a shear groove extending radially into the shroud and each connection pin has a biasing pin extending therefrom, each biasing pin being spring loaded within its corresponding connection pin and extending into a corresponding shear groove when its corresponding connection pin is placed into a key-hole and connection-hole, thereby biasing its corresponding connection pin against the corresponding tie-bar.

3. The excavation bucket assembly of claim 2 wherein each connection pin further includes an oil-ring groove with an O-ring mounted therein to inhibit foreign matter from entering the shear groove.

4. The excavation bucket assembly of claim 1 wherein the two ovals of each key-hole are an overlapping circular portion and an elliptical portion, the elliptical portion being located proximally with respect to the bucket body and the circular portion being located distally with respect to the bucket body.

5. The excavation bucket assembly of claim 4 wherein a distal portion of each circular portion is open.

6. The excavation bucket assembly of claim 4 wherein each connection pin is cylindrical in shape and each connection-hole includes a circular portion, each connection pin being inserted into a circular portion of a corresponding key-hole and a circular portion of a corresponding connection-hole when a shroud is connected to the bucket body.

7. The excavation bucket assembly of claim 6 wherein each tie-bar has a first face that has a rounded contour that abuts a corresponding connection pin and a second face that abuts the lip of the bucket body and includes a concave portion.

8. The excavation bucket assembly of claim 7 wherein each connection-hole of the shroud has a shear groove extending radially into the shroud and each connection pin has a biasing pin extending therefrom, each biasing pin being spring loaded within its corresponding connection pin and extending into a corresponding shear groove when its corresponding connection pin is placed into a key-hole and a connection-hole, thereby biasing its corresponding connection pin against the corresponding tie-bar.

9. The excavation bucket assembly of claim 8 wherein each connection pin further includes an oil-ring groove with an O-ring mounted therein to inhibit foreign matter from entering the shear groove.

10. The excavation bucket assembly of claim 9 wherein a distal portion of the circular portion of each key-hole is open.

11. The excavation bucket assembly of claim 1 further comprising a plurality of tooth assemblies, each tooth assembly comprising:

a body portion that fits over the lip of the bucket body;

a nose portion integral with the body portion and having a hole defined therein, the hole including a radially extending groove;

a tooth portion having a hole defined therein; and a connecting pin, the connecting pin comprising a top detent and a locking portion;

wherein the tooth portion is mounted over the nose portion such that their respective holes are aligned and the connecting pin is inserted into the holes such that the top detent abuts the nose portion and the locking portion engages the radially extending groove.

12. The excavation bucket assembly of claim 11 wherein the top detent is part of an inner body portion of the connecting pin, the inner body portion comprising an elastomeric material.

13. The excavation bucket assembly of claim 12 wherein the inner body portion includes a biasing portion that engages the locking portion.

14. The excavation bucket assembly of claim 11 wherein each tooth assembly further comprises a tooth shroud mounted over the nose portion adjacent the tooth portion.

15. The excavation bucket assembly of claim 11 wherein the tooth portion has a recess defined therein on an underside of the tooth portion.

16. The excavation bucket assembly of claim 13 wherein the two ovals of each key-hole are an overlapping circular portion and an elliptical portion, the elliptical portion being located proximally with respect to the bucket body and the circular portion being located distally with respect to the bucket body.

17. The excavation bucket assembly of claim 16 wherein each connection-hole of the shroud has a shear groove extending radially into the shroud and each connection pin has a biasing pin extending therefrom, each biasing pin being spring loaded within its corresponding connection pin and extending into a corresponding shear groove when its corresponding connection pin is placed into a key-hole and connection-hole, thereby biasing its corresponding connection pin against the corresponding tie-bar.

18. The excavation bucket assembly of claim 17 wherein each connection pin further includes an oil-ring groove with an O-ring mounted therein to inhibit foreign matter from entering the shear groove.

19. The excavation bucket assembly of claim 16 wherein each connection pin is cylindrical in shape and each connection-hole includes a circular portion, each connection pin being inserted into a circular portion of a corresponding key-hole and a circular portion of a corresponding connection-hole when a shroud is connected to the bucket body.

20. The excavation bucket assembly of claim 19 wherein each tie-bar has a first face that has a rounded contour that abuts a corresponding connection pin and a second face that abuts the lip of the bucket body and includes a concave portion.

21. The excavation bucket assembly of claim 20 wherein each connection-hole of the shroud has a shear groove extending radially into the shroud and each connection pin has a biasing pin extending therefrom, each biasing pin being spring loaded within its corresponding connection pin and extending into a corresponding shear groove when its corresponding connection pin is placed into a key-hole and connection-hole, thereby biasing its corresponding connection pin against the corresponding tie-bar.

22. The excavation bucket assembly of claim 21 wherein each connection pin further includes an oil-ring groove with an O-ring mounted therein to inhibit foreign matter from entering the shear groove.

23. The excavation bucket assembly of claim 22 wherein a distal portion of the circular portion of each key-hole is open.

24. An excavation bucket assembly for an excavation apparatus, the assembly comprising:

a bucket body having a lip running longitudinally along a bottom front portion of the bucket body; and a plurality of tooth assemblies for connection to the bucket body, each tooth assembly comprising:

a body portion that fits over the lip of the bucket body;

a nose portion integral with the body portion and having a hole defined therein, the hole including a radially extending groove;

a tooth portion having a hole defined therein; and a connecting pin, the connecting pin comprising a top detent and a locking portion;

wherein the tooth portion is mounted over the nose portion such that their respective holes are aligned and the connecting pin is inserted into the holes such that the top detent abuts the nose portion and the tooth portion and the locking portion engages the radially extending groove.

25. The excavation bucket assembly of claim 24 wherein the top detent is part of an inner body portion of the connecting pin, the inner body portion comprising an elastomeric material.

26. The excavation bucket assembly of claim 25 wherein the inner body portion includes a biasing portion that engages the locking portion.

27. The excavation bucket assembly of claim 24 wherein each tooth assembly further comprises a tooth shroud mounted over the nose portion adjacent the tooth portion.

28. The excavation bucket assembly of claim 24 wherein the tooth portion has a recess defined therein on an underside of the tooth portion.

29. The excavation bucket assembly of claim 26 further comprising:

a plurality of key-holes defined within the lip, each key-hole comprising two ovals;

a plurality of shrouds for connection to the bucket body, each shroud having a connection-hole that aligns with a corresponding key-hole when its respective shroud is connected to the body;

a plurality of tie-bars, each tie-bar being placed in a corresponding one of the key-holes and connection-holes when a shroud is connected to the bucket body; and a plurality of connection pins, each connection pin being placed in a corresponding one of the key-holes and a corresponding connection-hole when a shroud is connected to the bucket body and being biased against a corresponding tie-bar;

wherein each connection-hole of the shroud has a shear groove extending radially into the shroud and each connection pin has a biasing pin extending therefrom, each biasing pin being spring loaded within its corresponding connection pin and extending into a corresponding shear groove when its corresponding connection pin is placed into a key-hole and connection-hole, thereby biasing its corresponding connection pin against the corresponding tie-bar.

30. The excavation bucket assembly of claim 29 wherein each connection pin further includes an oil-ring groove with an O-ring mounted therein to inhibit foreign matter from entering the shear groove.

31. The excavation bucket assembly of claim 30 wherein the two ovals of each key-hole are an overlapping circular portion and an elliptical portion, the elliptical portion being located proximally with respect to the bucket body and the circular portion being located distally with respect to the bucket body.

32. The excavation bucket assembly of claim 31 wherein a distal portion of each circular portion is open.

33. The excavation bucket assembly of claim 32 wherein each connection pin is cylindrical in shape and each connection-hole includes a circular portion, each connection pin being inserted into a circular portion of a corresponding key-hole and a circular portion of a corresponding connection-hole when a shroud is connected to the bucket body.

34. The excavation bucket assembly of claim 33 wherein each tie-bar has a first face that has a rounded contour that abuts a corresponding connection pin and a second face that abuts the lip of the bucket body and includes a concave portion.

* * * * *